US006651949B1

(12) United States Patent
Westhoff et al.

(10) Patent No.: US 6,651,949 B1
(45) Date of Patent: Nov. 25, 2003

(54) APPARATUS FOR CASTING A GASKET AND ASSOCIATED POSITIONING MEMBER INTO AN OPENING AND A CAST MEMBER FOR RECEIVING A CONDUIT

(75) Inventors: James A. Westhoff, Langhorne, PA (US); James A. Kelly, Upper Black Eddy, PA (US)

(73) Assignee: Poly-Tec Products, Inc., Tullytown, PA (US)

( * ) Notice: Subject to any disclaimer, the term of this patent is extended or adjusted under 35 U.S.C. 154(b) by 0 days.

(21) Appl. No.: 09/533,426

(22) Filed: Mar. 22, 2000

Related U.S. Application Data

(60) Provisional application No. 60/125,853, filed on Mar. 24, 1999.

(51) Int. Cl.[7] ..... B28B 7/28

(52) U.S. Cl. ..... 249/63; 249/96; 249/142; 249/177

(58) Field of Search ..... 249/35, 39, 63, 249/83, 96, 142, 177

(56) References Cited

U.S. PATENT DOCUMENTS 3,727,876 A * 4/1973 Keyser ..... 249/184
3,758,066 A * 9/1973 Skinner et al. ..... 249/184
3,796,406 A * 3/1974 Ditcher ..... 248/499
4,650,149 A * 3/1987 Poulette et al. ..... 249/11
4,805,920 A * 2/1989 Gavin ..... 277/606
4,854,543 A * 8/1989 Daigle et al. ..... 249/11
4,951,914 A * 8/1990 Meyers et al. ..... 220/3.4
5,171,507 A * 12/1992 Del Zotto ..... 264/219
RE34,787 E 11/1994 Westhoff et al. ..... 277/207
5,655,564 A * 8/1997 Gavin ..... 137/363
5,711,536 A * 1/1998 Meyers ..... 277/606
5,997,006 A 12/1999 Westhoff et al. ..... 277/604

* cited by examiner

*Primary Examiner*—James P. Mackey
*Assistant Examiner*—Donald Heckenberg
(74) *Attorney, Agent, or Firm*—Volpe and Koenig, P.C.

(57) ABSTRACT

Method and apparatus for casting a gasket into a cast member utilizing a one-piece mandrel assembly provided within a mold assembly. The resilient, compressible gasket is mounted upon the mandrel assembly during the casting operation. The mandrel assembly is withdrawn from the cast member after it has cured. The mandrel assembly may also be utilized to form a knockout barrier a pipe stop and a mounting fixture for mounting a baffle to the interior wall of the cast member through a snap on fastening arrangement. The mandrel assembly is preferably designed to facilitate stripping of the mandrel assembly from the cast member after the cast member is cured.

13 Claims, 9 Drawing Sheets

APPARATUS FOR CASTING A GASKET AND ASSOCIATED POSITIONING MEMBER INTO AN OPENING AND A CAST MEMBER FOR RECEIVING A CONDUIT

CROSS REFERENCE TO RELATED APPLICATIONS

This application claims priority from U.S. Provisional application No. 60/125,853; filed Mar. 24, 1999, which application is incorporated herein by reference.

FIELD OF THE INVENTION

The present invention relates to method and apparatus for casting a gasket into a cast member and more particularly, to a gasket and a positioning ring upon which the gasket is force fittingly mounted and method and apparatus for casting same.

BACKGROUND OF THE INVENTION

It is conventional in septic tanks, as well as other cast members, such as concrete structures, to provide openings, within the cast member to accommodate the insertion of a pipe therethrough.

Septic tanks, as well as other similar structures, are cast in a mold assembly, typically comprised of inner and outer mold members which respectively define the interior and exterior walls thereof.

In one conventional casting operation, the outer walls or jackets defining the outer periphery of the cast member are swingably mounted near their lower ends. Preparatory to casting, the pivotally mounted outer jackets are swung to an upright, vertical (i.e., "closed" ) position in readiness for receiving the cast material.

Cast members, such as septic tanks are typically four-sided, rectangular-shaped members having at least one opening provided one or more of its side walls.

One technique presently being utilized to define the opening in a side wall of the cast member is to fixedly secure a metal or plastic mandrel to the inner wall of an outside jacket A one-piece pipe seal is releaseably mounted upon the mandrel, whereupon the outer jacket is swung to the upright vertical position in readiness for pouring of the cast material. The pipe seal has an outer peripheral flange, which is anchored within the cast material.

After the cast material has set, the outer jackets are opened to remove the cast member. The mandrel pulls away from the pipe seal, which is retained within the sidewall of the cast member.

The pipe seal typically has an integral central portion which seals the side wall in the event that no pipe is to be inserted through that side wall and further is provided with circular sections which may be easily torn away to form an opening for accommodating two, three or four inch pipes, for example.

A pipe of the suitable diameter is inserted into the opening of the pipe seal. The pipe seal is formed of a substantially non-resilient plastic material and, at best, forms what is referred to as a "dirt seal" with the pipe, enabling undesirable materials to leach into the cast member, as well as, allowing undesirable materials within the cast member to seep out.

In addition, the pipe quite frequently is utilized to support internal components, such as baffles and filter systems which, due to their significant weight, as well as the weight of the pipe itself, cause the "dirt seal" to further weaken and deteriorate, enabling even greater seepage of undesirable materials through the "dirt seal".

BRIEF DESCRIPTION OF THE INVENTION

The present, invention is characterized by comprising method and apparatus for providing a water-tight seal for cast members, such as septic tanks and the like, wherein the water-tight seal is obtained through the use of an inexpensive and yet rugged gasket which is highly, effective in providing an excellent water-tight seal between the opening and a pipe inserted through the gasket and which further assures highly accurate positioning of the gasket within the cast member.

The present invention comprises a resilient, compressible rubber or rubber-like gasket of annular shape having a main body portion with anchoring means extending radially outwardly therefrom and joined to the main body portion by a flexing portion which is adapted to bend upon insertion of a pipe enabling one side surface of the main body portion to make surface contact with the pipe over a significant area to provide a good water-tight seal.

In addition thereto, water-energizing pockets are provided as is described in detail in U.S. Pat. No. Re 34,787 and pending application Ser. No. 08/947,755, filed Oct. 9, 1997, now U.S. Pat. No. 5,997,006 issued Dec. 7, 1999, which patents are assigned to the assignee of the present application, the teachings thereof being incorporated herein by reference thereto. The water energizing pockets further enhance the water-tight seal, as is described in detail in the aforementioned U.S. Patent and co-pending application.

An annular-shaped plastic mandrel has a radially, inwardly directed annular flange or "hook" portion which snaps over the gasket and locks the gasket in place on the mandrel. The plastic mandrel serves as a means for defining the opening within the cast member along the interior side of the member.

The gasket assembly which is now comprised of the interlocked gasket and plastic mandrel are placed onto the metal or plastic outer, mandrel, which is typically welded or bolted to the interior surface of the swingably mounted, outside jacket. The jacket is then moved to the upright ("closed") position preparatory to the casting operation, whereupon the cast material is poured into the mold. The side of the plastic mandrel opposite the hook portion joined to the gasket engages the interior wall of the inside jacket and thereby cooperates with the metal or plastic outer mandrel to properly position and space the gasket between the interior walls of the inner and outer mold members.

When the cast material (i.e., concrete) is cured, the outside jacket is swung away from the vertical position whereupon the outside jacket and outer mandrel are stripped away from the gasket assembly, leaving the gasket and plastic mandrel anchored within the cast member. The, plastic mandrel is provided with a left-hand portion of reduced diameter relative to the portion adjacent. thereto, forming a shoulder which locks the plastic mandrel within the cast member due to the cast material filling in the portion of reduced diameter and resting against the shoulder to prevent the plastic mandrel from being dislodged from the cast member. Although the hook portion of the plastic mandrel is maintained within one of the water energizing pockets, the water energizing pocket, which is effective upon insertion of the pipe, is on the opposite side of the plastic mandrel so that the plastic mandrel does not in any way reduce the effectiveness of active water energizing pocket.

In one preferred embodiment, the plastic mandrel may be fitted with a hollow, annular-shaped pipe stop which is snap fitted to the end of the plastic mandrel remote from the gasket. The pipe stop extends radially inward by a distance sufficient so as to be engaged by the end of a pipe inserted into the gasket causing the pipe to rest against the stop and thereby control the depth to which the pipe is inserted into the opening in the cast member. As is described in detail in the aforementioned U.S. Pat. Nos. Re 34,787 and 5,997,006, the gasket, together with its water energizing pocket provides an excellent water-tight seal.

As another preferred embodiment of the present, a cover plate may be snap-fitted over the end of the plastic mandrel opposite the hook shaped end, providing a water-tight closure for the cast member. The cover plate is formed of a suitable plastic material which may be cut away at some future time to provide for insertion of a pipe.

Although the outer jacket swings away from the cast member after it has been cured, moving along an arcuate path, the gasket is sufficiently yieldable to enable the outer jacket and outer mandrel to be readily and easily stripped from the gasket without any undesirable displacement, due to the resiliency and compressibility of the gasket. The plastic mandrel further provides the function of assuring proper placement and positioning of the gasket between,the inner and outer mold members, the need for providing a mandrel which extends all the way to and engages the inner mold member, is thus eliminated.

In still another preferred embodiment of the present invention, a reusable mandrel is secured to the swingable jacket of a mold assembly. The mandrel is comprised of a slightly tapered inside portion and a more severely tapered outside portion separated by a gap which forms a recess for receiving the gasket. A gasket of the type described hereinabove having water-energizing pockets, is stretched over the mandrel, which is preferably formed of plastic so that the pipe engaging portion of the gasket is seated in the recess. The mold assembly jacket is then swung to the closed position whereupon the cast material is poured into the mold assembly. After the cast material (preferably concrete) is cured, the jacket is then opened whereupon the mandrel is stripped out through the gasket. Due to the design of the mandrel such that the diameter of the inside portion of the mandrel adjacent the recess is smaller than the diameter of the outside portion of the mandrel adjacent brand on the opposite side of the recess, the gasket freely rolls over and away from the mandrel, enabling removal of the mandrel.

The mandrel may have a shoulder machined at its rear end to provide a pipe stop, assuring that when a pipe is inserted into the opening, the pipe stop limits the depth of insertion of the pipe into the opening in the cast member, preventing unwanted penetration into the interior of the structure.

In still another embodiment, the interior end of the mandrel may be designed to have an axial length which is less than the thickness of the cast member (typically of the order of 0.50 inches), thereby cooperating with the core and jacket members of the mold assembly to form a block-out area at each location where a gasket is placed on order to initially close the block out openings, while selectively enabling breakout of the block-but area according to the number and position of pipes to be inserted into the cast member.

A plastic cap may be snapped onto the interior end of the plastic mandrel for use as a temporary plug or block-out, as an alternative to the block-out area mentioned hereinabove.

In applications where septic tanks require baffles anchored in the wall, the mandrel can be provided with a machined area to lock a fixture onto the tank, which fixture is provided with fasteners for the baffle assembly which can be locked into the concrete when cast, enabling a baffle to be simply snapped onto the fixture at the job site.

OBJECTS OF THE INVENTION

It is therefore one object of the present invention, to provide novel method and apparatus for providing an inexpensive and yet highly effective gasket within a cast member to provide a water-tight seal not heretofore capable of being provided at such low cost.

Another object of the present invention to provide novel method and apparatus for providing an inexpensive and yet highly effective gasket within a cast member to provide a water-tight seal which is yieldable under load and yet retains the water-tight seal even upon up/down or left/right movement of the pipe.

Still another object of the present invention is to provide a novel method and apparatus for casting a gasket within a cast member wherein a plastic mandrel is utilized to accurately control the proper positioning of the gasket within the cast member, and to accurately control the inside diameter of the opening.

Still another object of the present invention is to provide, a novel gasket/mandrel assembly comprised of a gasket and mandrel which is snap-fittingly coupled to the gasket so that the gasket/mandrel assembly may be simply and readily inserted into a mold assembly as a unit for producing a cast member having a gasket embedded therein.

Still another object of the present invention is to provide a novel method and apparatus for casting a gasket within a cast member in which the gasket is provided with novel water energizing pockets, one of which is utilized to snap fittingly couple the gasket to the plastic member to make a composite, unified gasket/mandrel assembly which simplifies storage, shipping, handling and assembly into a casting mold.

Still another object of the present invention is to provide a novel gasket/plastic mandrel assembly which includes a snap-on pipe stop member for controlling the depth of insertion of a pipe into the gasket.

Still another object of the present invention is to provide a novel method and apparatus for casting gaskets into a cast member in which a plastic mandrel/gasket assembly is further provided with a cover plate to provide a water-tight seal in the cast member, which cover plate may be cut away to provide an opening for a pipe line at some future time.

Still another object of the present invention is to provide a novel method and apparatus for casting gaskets into an opening in a cast member in which a gasket is mounted upon a reusable mandrel which is removed by being drawn through the gasket when the cast member has set.

Still another object of the present invention is to provide a novel method and apparatus employing a reusable mandrel assembly adapted for providing a block-out area within a cast member.

Still another object of the present invention is to provide a novel method and apparatus for casting gaskets into a cast member employing a reusable mandrel assembly which may be fitted with a fixture embedded within the cast member for snap-fittingly mounting a baffle thereto.

BRIEF DESCRIPTION OF THE FIGURES

The above as well as other objects of the invention will become apparent when reading the accompanying description and drawings in which:

FIG. 2 is a view showing the manner in which the plastic mandrel and gasket are snapped to one another; FIG. 3 shows the manner in which the gasket/mandrel assembly is placed about a metal or plastic mandrel provided on an outside jacket of a mold assembly;

FIG. 4 shows the position of the mold assembly after the gasket assembly is completed and in readiness to receive the cast material; and FIG. 5 shows the manner in which the jacket is opened after the cast member (concrete) is cured;

DETAILED DESCRIPTION OF THE INVENTION AND PREFERRED EMBODIMENTS THEREOF

Figure 1:
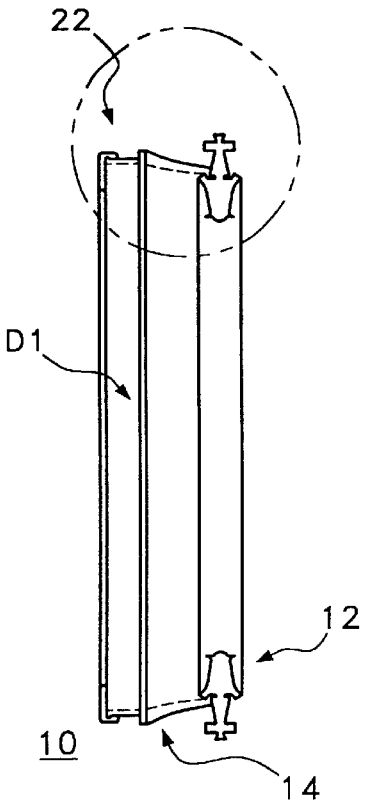
FIG. 1 is a simplified diagrammatical view of a gasket, plastic mandrel and pipe stop designed in accordance with the principles of the present invention.
Figure 1A:
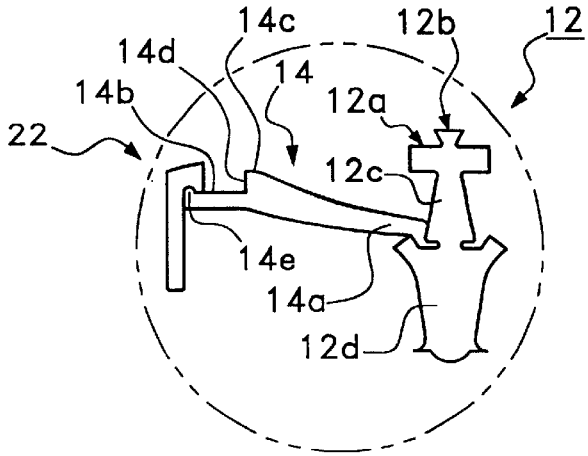
FIG. 1*a* is an enlarged detailed view showing a portion of the pipe stop, plastic mandrel and gasket.
Figure 1B:
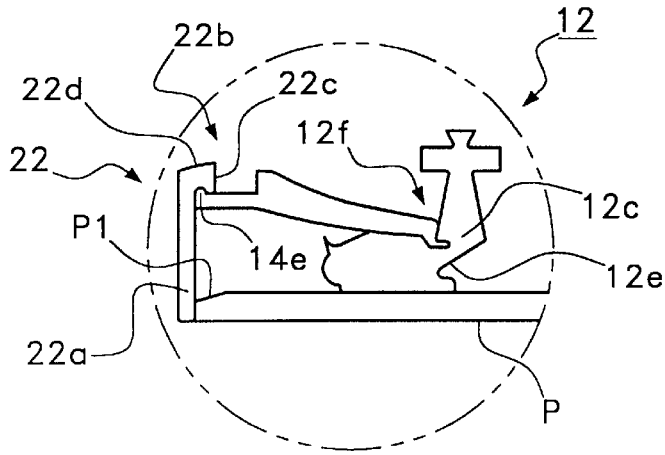
FIG. 1*b* is an enlarged sectional view similar to the view of FIG. 1*a* and showing the orientation of the gasket after a pipe is pushed therethrough.

FIGS. 1, 1*a*, and 1*b* show a mandrel/gasket assembly 10 designed in accordance with, and embodying, the principles of the present invention and comprised principally of a gasket 12 and plastic mandrel 14.

Gasket 12 is a novel gasket described the aforementioned U.S. Pat. Nos. Re 34,787 and 5,997,006, which patents are incorporated herein by reference thereto. For purposes of understanding the gasket, only a simplified description will be given herein, the details of, the gasket being obtainable by reference to the aforementioned. U.S. Patents. The gasket 12 is comprised of an anchoring section 12*a* which is a substantially T-shaped portion having a solid, truncated V-shaped portion 12*b* integral with the top surface thereof. The radially aligned portion 12*c* of the T-shaped anchoring portion 12*a* tapers so as to have an increasing width moving radially inward toward the center thereof. The tapered portion 12*c* is joined to a substantially A-shaped body portion 12*d* which, as can be seen in FIG. 1*b*, rests against pipe P when the pipe is in the inserted position.

The region between, the tapered portion 12*c* and body 12*d* is provided with a pair of water energizing pockets 12*e* and 12*f* which, as is described in detail in the aforementioned issued U.S. Patent and co-pending application, enhance the water-tight seal between the gasket 12 and pipe P embraced thereby.

Figure 5:
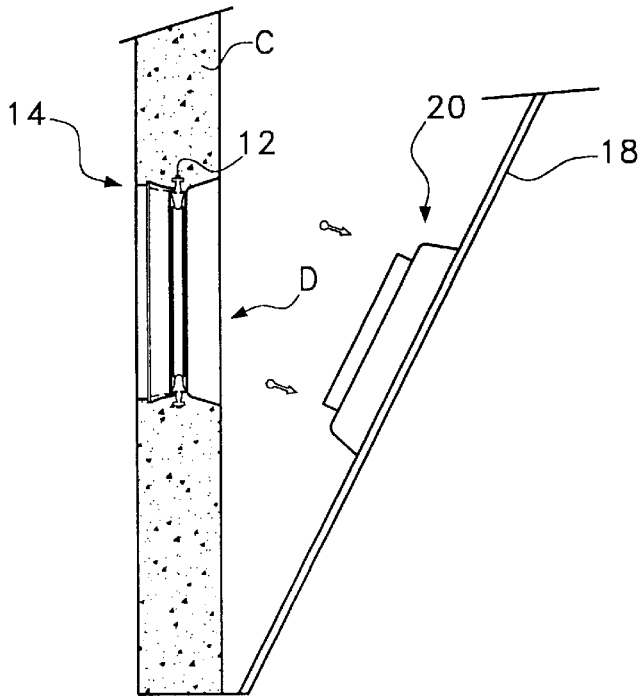

The plastic mandrel 14 is a substantially hollow, cylindrical-shaped member having an outer periphery which serves to define the opening in the cast member to the interior (i.e., "left" ) side of the gasket as is shown, for example, in FIG. 5 and will be described hereinbelow in greater detail. The right-hand end of mandrel 14 is provided with an annular, radially inwardly directed hook-shaped portion 14*a* which is snap-fittingly received within the water energizing pocket 12*f*, as best shown in FIGS. 1*a* and 1*b*. The left-hand end of mandrel 14 is provided with an annular portion 14*b* of reduced outer diameter relative to portion 14*c* so as to define a shoulder 14*d* which serves as a means to assure that the mandrel 14 is properly retained and anchored within the cast member, the cast material filling in the region of reduced diameter 14*b* and shoulder 14*d*, as shown in FIGS. 1*a* and 5.

Figure 2:
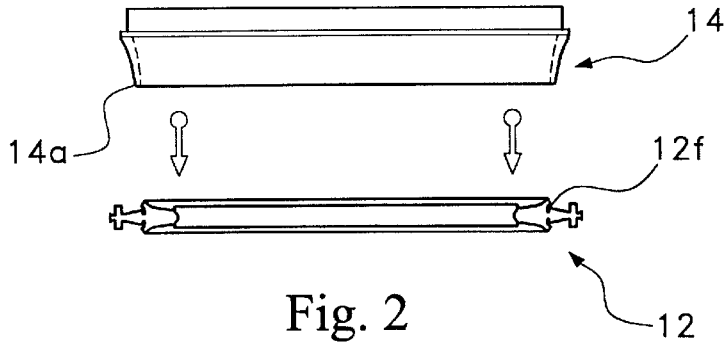
FIGS. 2–5 are views useful in describing the steps in casting the gasket and plastic mandrel assembly into a cast member wherein, more specifically.

The mandrel 14 and gasket 12 are snap-fitted to one another as shown in FIG. 2 by positioning the plastic mandrel over the gasket and forcing the hook-shaped end 14*a*, of plastic mandrel 14 into the water energizing pocket 12*f*, force-fittingly coupling gasket 12 and mandrel 14 to one another to form a single unit which greatly facilitates storage and shipment to a manufacturing site as well as installation into a mold assembly.

Figure 3:
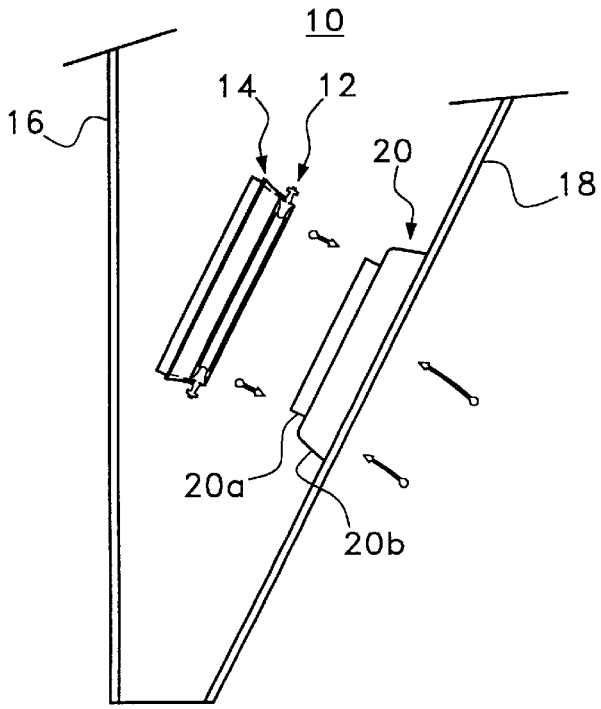

FIG. 3 shows the manner in which the mandrel/gasket assembly 10 is mounted into a mold assembly. FIG. 3 shows an inner mold member 16 and an outside jacket 18 hingedly mounted at its lower end (the pivotal mount being omitted for purposes of simplicity).

A metal mandrel 20 is fixedly secured to the interior surface of hingedly mounted jacket 18, preferably by a cooperating nut and bolt assembly. The position of mandrel 20 is accurately fixed in order to properly align the gasket and mandrel within the assembly. The mandrel/gasket assembly 10 is placed upon the metal or plastic mandrel 20 so that the gasket 12 receives and surrounds the projecting portion 20*a* of mandrel 20, as shown in FIGS. 3 and 4.

Figure 4:
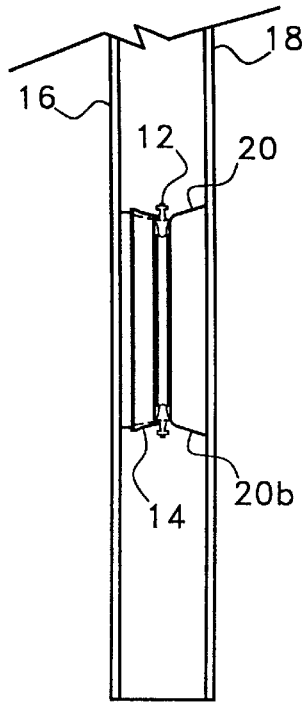

The outside jacket 18, with the assembly 10 fitted on mandrel 20 is then moved to the vertical ("closed" ) position, shown in FIG. 4, and the outside jacket is fixedly maintained in position by suitable clamping means (not shown for purposes of simplicity) and is now in readiness to receive the cast material, i.e., concrete, which is poured into the mold.

The left-hand edge of the plastic mandrel 14 rests against the adjacent surface of the inner mold member 16, cooperating with mandrel 20 to accurately position, and locate the gasket 12 between the inner and outer mold members. The truncated, conical surface portion 20*b* of metal mandrel 20 further serves to define the opening formed within the cast member to the right of the gasket, as is best seen in FIG. 5.

After the concrete is poured into the form and the concrete is cured, the outside jacket 18 is swung open to the position shown in FIG. 5, for example, which strips the outside jacket 18 and mandrel 20 away from the gasket assembly. The anchoring portion of the gasket assembly is firmly anchored within the cast material C as well as the plastic mandrel 14. As can be seen, the opening O to the right-side of gasket 12 has a truncated conical shape, defined by the truncated, conical portion 20*b* of mandrel 20.

In another preferred embodiment, a pipe stop 22 may be fitted upon the left end of plastic mandrel 14, as shown in FIGS. 1, 1*a*, and 1*b*. Pipe stop 22 has a substantially planar ring-shaped portion 22*a* defining a central opening O1. An integral flange 22*b* is formed at the outer periphery of ring-shaped portion 22*a* and extends toward plastic mandrel 14. Plastic mandrel 14 is provided with an outwardly directed, locking projection 14*e* which cooperates with a complementary, inwardly directed locking projection 22*c*, enabling the pipe stop 22 to be snap-fittingly joined to plastic mandrel 14. The tapered surface 22*d* of pipe stop 22 is surrounded by the cast material in the cast member, serving the securely retain pipe stop 22 in place.

The pipe stop 22 functions to limit the depth of penetration of pipe P. Noting FIG. 1*b*, for example, pipe P is pushed into the opening O (also see FIG. 5), bending portion 12*c* and causing 14. the gasket 12 to assume the orientation shown in FIG. 1*b*. The left-hand end of pipe P is pushed past the gasket 12 and abuts against pipe stop 22 which limits the depth of penetration. As will be noted from FIG. 1*b*, pipe P has a beveled marginal portion P1 facilitating insertion of the pipe into gasket 12. A lubricant may be applied to the gasket and/or pipe, if desired, to facilitate insertion.

As still another alternative arrangement, the pipe stop may be replaced by a solid cover plate substantially identical in design to pipe stop 22 except that the cover plate is a solid substantially circular-shaped member which serves to seal the interior opening O1. A central portion of the cover plate may be subsequently cut away in order to provide for a future line.

Figure 10:
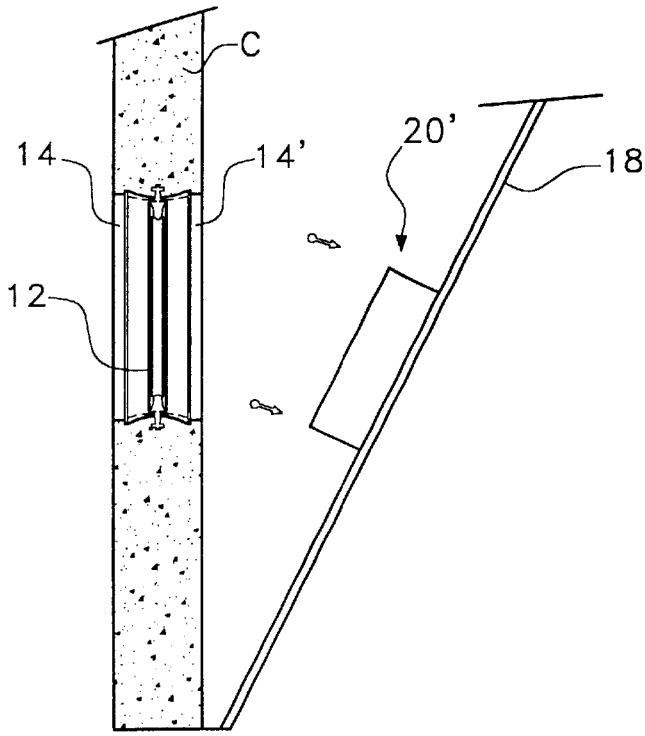

If desired, a second plastic mandrel, (respectively shown in FIGS. 6–10 and similar to mandrel 14), may be arranged on the opposite side of the gasket and similarly provided with a hook-shaped projection for locking into the water stop 12*e*. The second mandrel may be positioned over the metal mandrel secured to the outer jacket 18 which need be sufficient only to support the second mandrel. The second mandrel thus serves as the means for defining the truncated, conical opening to the right-side of gasket 12, as shown in FIG. 10.

Figure 7:
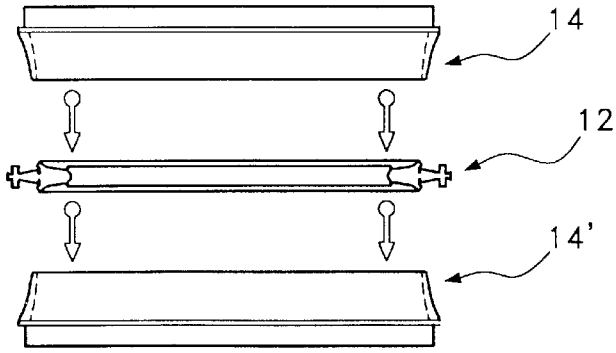
Figure 8:
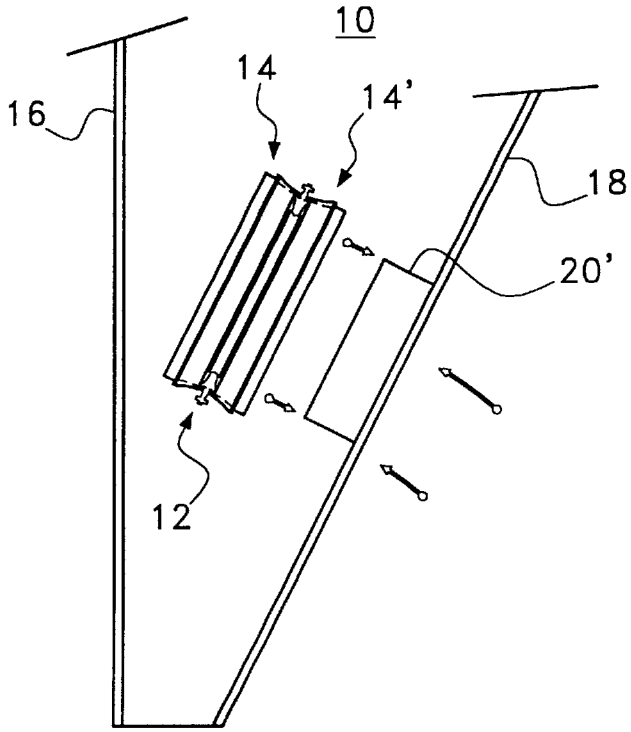
Figure 9:
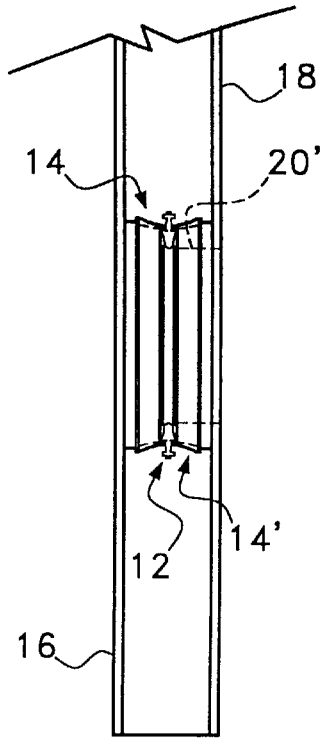

The method for forming cast member with a gasket embedded therein is substantially similar to the casting method employing only a single plastic mandrel. The additional steps include snap fitting first and second plastic mandrels 14, 14' to opposite water stop recesses 12*e*, 12*f* in the gasket (FIG. 6); and mounting the "second" plastic mandrel 14' upon a suitable metal mandrel 20' (FIG. 7). The remaining steps of the method (see FIGS. 8 and 9) are the same as those previously described except that when the cast member is cured and the outside jacket is opened, shown in FIG. 10, the "second" mandrel 14' is retained with the cast member due to its configuration, which is substantially a mirror image of the plastic mandrel 14. This embodiment, assures accurate control of the shape and size of the openings O and O1 formed respectively, on the right- and left-hand sides of the gasket 12 and eliminates the problem of build up of cast material on mandrel 20 which is often quite difficult to remove and, due to its accumulation, increases the size of the opening O to the right-hand side of gasket 12.

Figure 6:
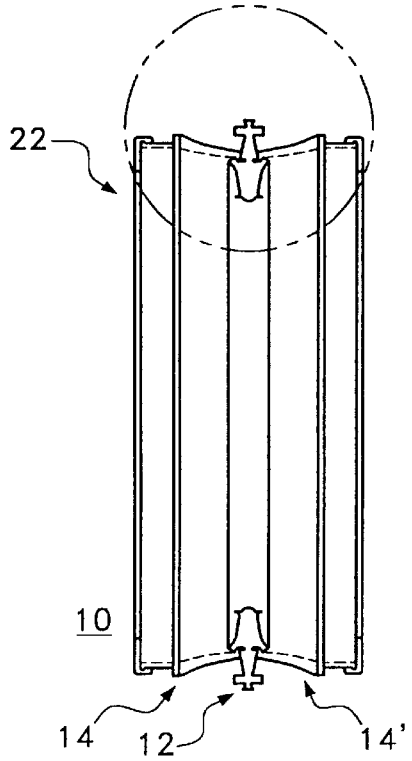
FIGS. 6 through 10 show views -similar to FIGS. 1–5 showing another preferred embodiment of the present invention.
Figure 6A:
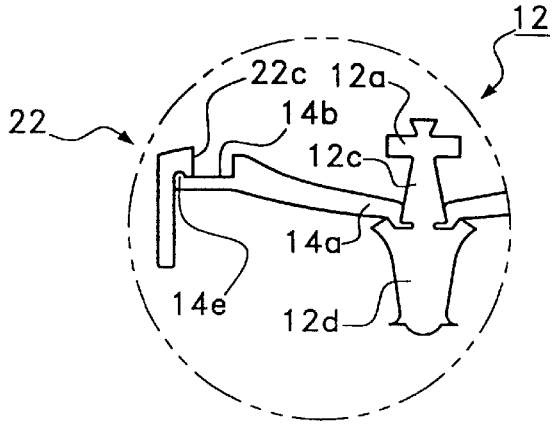
Figure 6B:
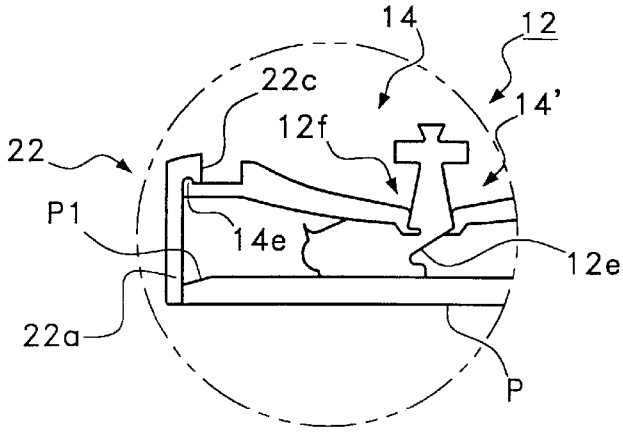

Note that when the gasket 14 is bent, as shown in FIG. 6*b*, due to insertion of pipe P, the energizing water pocket 12*e* moves away from mandrel 14' and is as effective in providing a water stop as the embodiment: shown in FIG. 1*b* in which mandrel 14' is not used. The pipe stop 22 (FIG. 6*a*) and closure 22 (FIG. 6) may also be employed in the embodiment of FIGS. 6–10.

Making reference to FIGS. 11 and 11*a*–11*d*, there is shown therein another preferred embodiment of a plastic mandrel assembly 30 preferably formed of a suitable plastic material, which is injection molded or a machined solid plastic member. However, any other suitable material, including metal, may be utilized.

Figure 11:
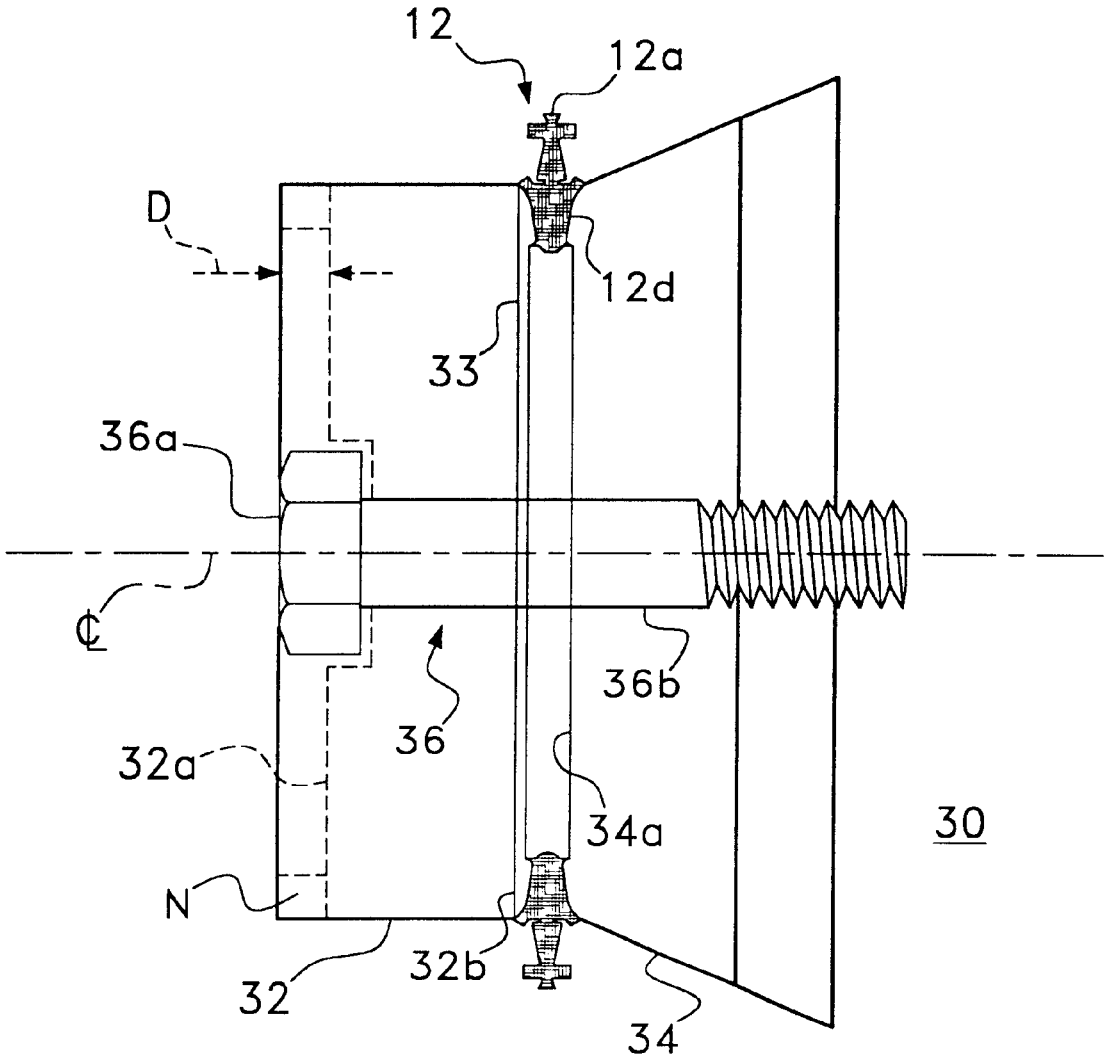
FIG. 11 shows a detailed view of another preferred embodiment of a mandrel assembly embodying the principles of the present invention.

The mandrel assembly 30 is preferably a unitary structure made up of two members joined together and having a slightly tapered, hollow, conical-shaped, inner section 32 and a more severely tapered outer hollow, conical-shaped section 34 there being a gap region 33 between sections 32 and 34 which is comprised of an annular recess for receiving and positioning the gasket 12 in the manner shown in FIG. 11, i.e., so that the portion 12*d* of the gasket is seated within the recess 33.

The left-hand end of the mandrel assembly, and more particularly, the left end of inner section 32 is provided with a recess 32*a* for receiving the head 36*a* of a bolt 36 whose main body portion 36*b* is threaded.

The circular, right-hand edge 32*b* of mandrel inner section 32 lies at a constant radial distance from center line CL and has a diameter which is slightly less than the diameter of the left-hand, circular edge 34*a* of outer section 34, which edge is also equidistant from center line CL. The significance of this design arrangement will be made apparent upon consideration of the description of the manner of which the mandrel assembly is employed.

FIGS. 11*a*–11*d* show the manner in which a cast member such as a septic tank, for example, is, cast.

The mold assembly for casting the member comprises an inner core 16 and a hinged outer jacket 20 similar to that described in the previous embodiments. Bolt 36 extends through the center of the mandrel assembly 30 and through a suitable opening in jacket 20. A nut 38 threadedly engages the threaded portion 36*b* of bolt 36, securing the mandrel assembly 30 to jacket 20.

The gasket 12 is stretched over the inner portion 32 of mandrel assembly 30 and is moved over and to the right in order to seat portion 12*d* of gasket 12 in recess 33, as shown in FIGS. 11 and 11*b*–11*d*.

Figure 11D:
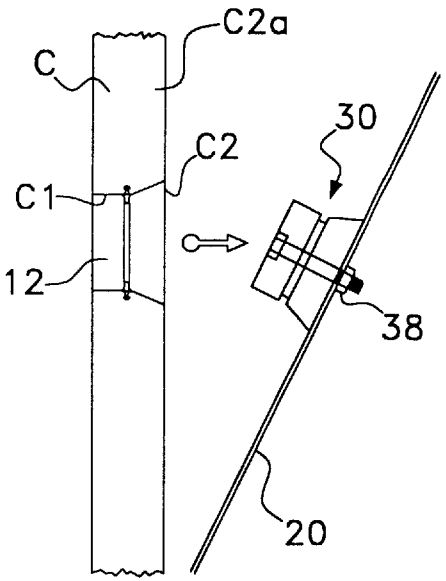
FIGS. 11*a* through 11*d* show the manner in which the mandrel assembly of FIG. 11 is utilized for the embedment of a gasket in an opening provided in a cast member.
Figure 11C:
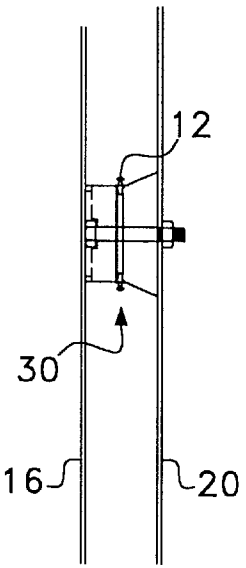
Figure 11B:
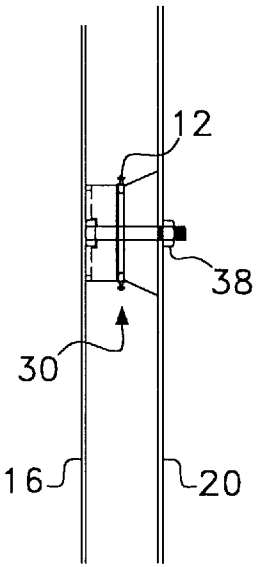
Figure 11A:
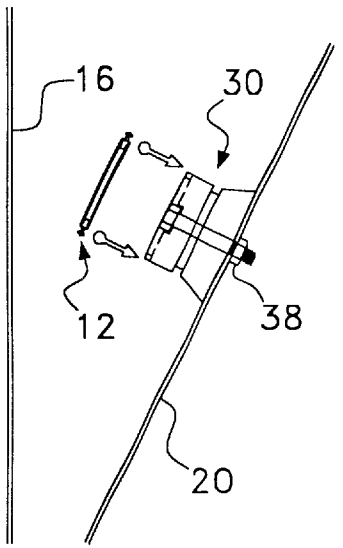

After assembly of the gasket 12 onto the mandrel assembly 30, jacket 20 is moved to the closed position. The concrete is then poured into the mold assembly, as shown in FIG. 11*b*.

The concrete is then cured, before jacket 20 is opened. When the jacket 20 is moved to the open position, as shown in FIG. 11*d* wherein the mandrel assembly 30 is pulled through and released from the gasket as it is moved to the right. The resiliency of the gasket 12 causes the gasket to deflect. In addition thereto, the reduced diameter of circular edge 32*b* relative to the circular edge 34*a*, assures the smooth release of the gasket portion 12*d* from recess 33. As with the prior embodiments, the embedment portion 12*a* of gasket 12 is firmly embedded within the cast member.

The outer conical surfaces of sections 32 and 34 define the annular surfaces C1 and C2 that lie on opposing sides of the gasket 12, as shown in FIG. 11*d*. The tapered, conical surface C2 aides in guiding a pipe into the opening within the cast concrete member C.

Prior to the novel design, shown in FIGS. 11–11*d*, some efforts have been put forth to provide a one-piece mandrel assembly for retaining a gasket in position during the casting operation. These designs have necessitated that the gasket lie extremely close to the left-hand surface C, shown in FIG. 11*d*, which results in inferior embedment of the gasket within the cast member.

Use of the novel mandrel design 30 shown in FIGS. 11*a*–11*d* enables the positioning of the gasket 12 a sufficient distance outward and away from the inside wall of the cast member so as to assure the provision of a rugged, reliable embedment of portion 12*a* within the cast member.

Figure 12:
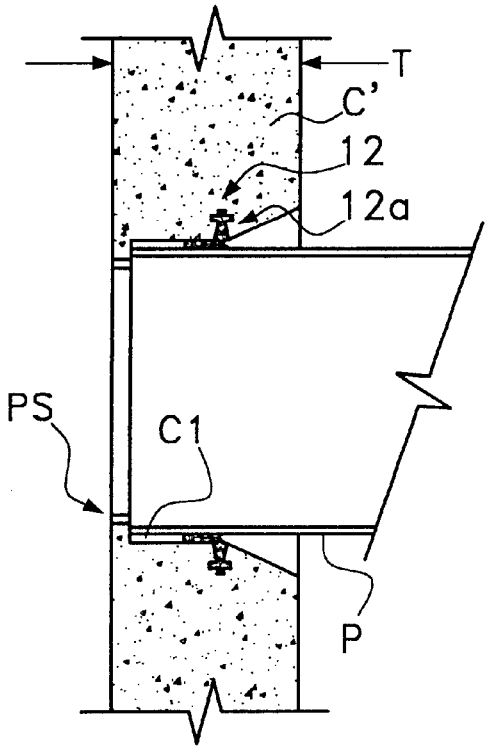
FIG. 12 is a sectional view showing a modified cast member obtainable through a mandrel of the type shown in FIG. 11 for providing a pipe stop area.

FIG. 12 shows another modified cast member which may be produced utilizing a slightly modified mandrel assembly.

By modifying the mandrel assembly, shown in FIG. 11, to provide a left-hand portion of inner mandrel portion 32 having a reduced diameter relative to the main portion of the mandrel and of an axial length D to thereby form an annular notched portion N, it is possible to form a cast member C', shown in FIG. 12, which, in addition to having the embedment portion 12*a* embedded therein, is further provided with annular pipe stop projection PS, which is of a reduced diameter, relative to the diameter of the portion C1. In this embodiment, the axial length of the mandrel assembly is equal to the thickness T of the cast member C. The casting operation is substantially identical to that described in connection with FIGS. 11–11*d* except that the cast material fills the notched region N. When the cast member has been cured and the mandrel assembly has been removed from the cured member C', the cast member C', is provided with a through-opening whose left-hand portion (relative to FIG. 12) has a pipe stop region PS of reduced diameter. The pipe stop functions to limit the depth of insertion of pipe PS when the left-hand edge of pipe P strikes against the right-hand edge of the pipe stop PS, as shown in FIG. 12.

Figure 13:
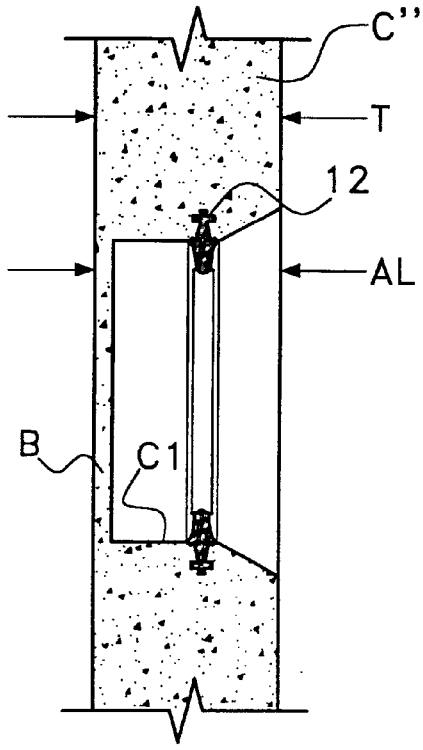
FIG. 13 is a section view showing a cast member having a block out area obtainable through the use of a mandrel assembly of the type shown in FIG. 11.

FIG. 13 shows another modification of a cast member which may be produced utilizing the mandrel assembly shown in FIG. 11. In this embodiment, the mandrel assembly has an axial length AL which is less than the thickness T of the member being cast (typically of the order of ½ inch difference). The casting operation is substantially identical to that described in FIGS. 11*a*–11*d*. However, since the left-hand end of the mandrel assembly is displaced from the core member 16 (see FIGS. 11*a*–11*c*) by a distance of the order of 0.5 inches, the cast material (i.e., concrete) fills this region, forming a block out area B. This technique and arrangement may be utilized when forming cast members in which it is desired to provide a plurality of gasketed openings around the walls of the cast member wherein it is not known until the time of installation as to what opening or openings and how many openings may be needed at a given installation. When the number of openings that are required and their locations are determined, the block out area B of the selected opening may be simply broken away in order to utilize the gasketed opening.

Figure 14:
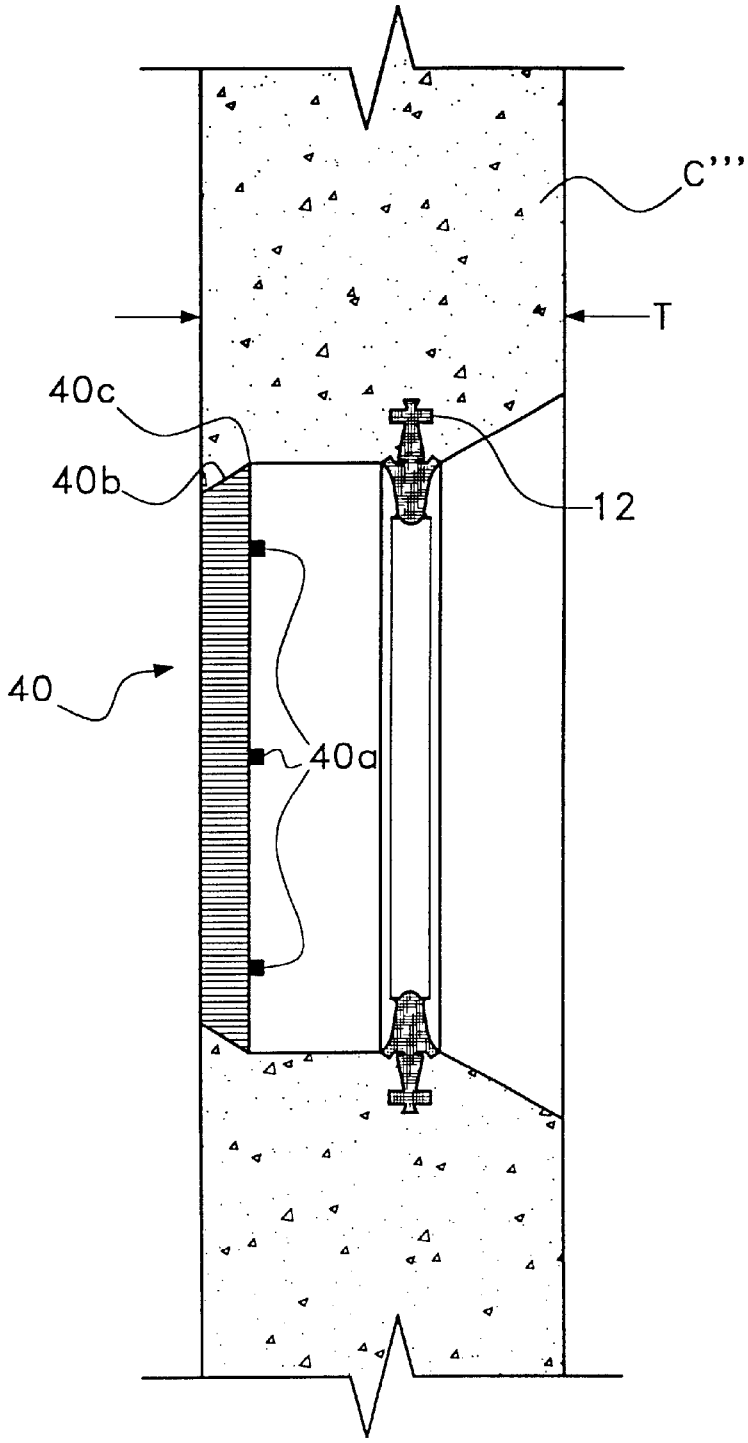
FIG. 14 shows another cast member having a plastic block-out, cap integrated into the cast member through the utilization of a mandrel assembly of the type shown in FIG. 11.

The modified cast member C'", shown in FIG. 14 may be formed utilizing a slightly modified form of the mandrel assembly 30, shown in FIG. 11. The left-hand end of the mandrel assembly is provided with three small openings, which may be arranged at equidistant locations about an imaginary circle for receiving projections 40*a* provide along the right-hand side of a knock-out plastic cap 40.

The casting technique is substantially identical to that described in connection with FIGS. 11*a*–11*d*. The mandrel assembly has an axial length, which, together with the thickness of the knock-out plastic cap 40, is equal to the thickness T of the member C'" to be cast. The knock-out plastic cap 40 has a circular shape and is provided with first and second beveled edges 40B and 40C. The cast material enters into, the region of the beveled edges, causing the knock-out plastic cap 40 to be retained within the cast member. The holding force between openings in the mandrel assembly 30 and projections 40*a* is significantly less than the holding force of the concrete surrounding the beveled edges 40*b*, 40*c* of the knock-out plastic cap, assuring that the knock-out plastic cap is retained in position when the mandrel assembly is pulled away from the cast member C'" as the jacket 20 is opened (see FIG. 11*c*).

The knock-out plastic cap 40 serves substantially the same function as the block out concrete area B, shown in FIG. 13, the knock-out plastic cap 40 being retained within the cast member.

The knock-out plastic cap is "knocked-out" when it is determined at a job site that a particular gasketed opening, is required for connection to a given pipe member. The plastic cap is simply knocked-out with a suitable tool providing a gasketed opening at the job site.

Figure 15A:
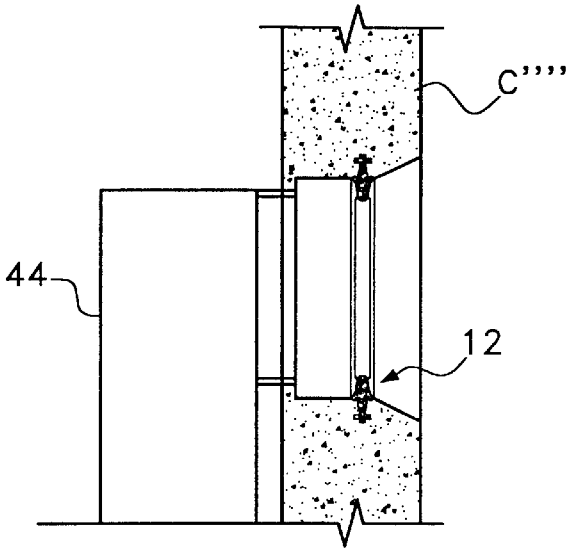
FIGS. 15*a*–15*c*, respectively, show vertical and horizontal sectional views and a front view of a cast member in which a plastic fixture is integrally joined to the cast member through, the employment of a mandrel assembly of the type shown in FIG. 11.
Figure 15B:
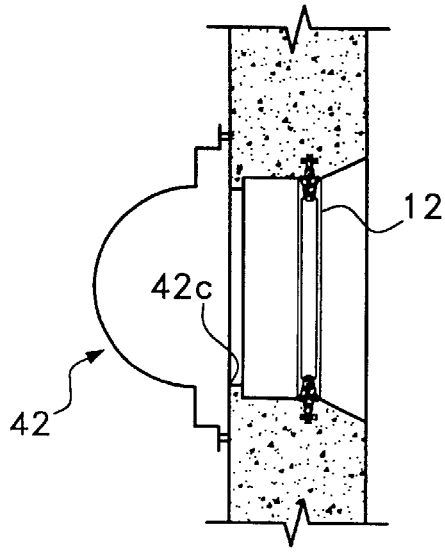
Figure 15C:
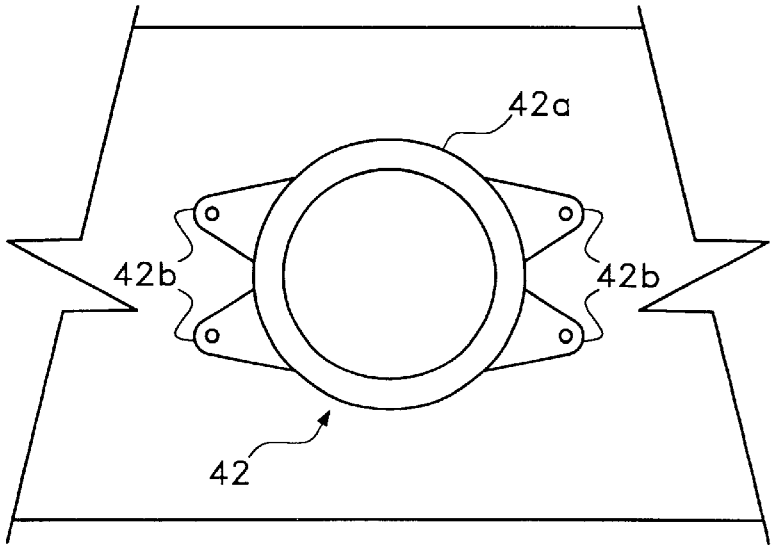

In applications where septic tanks require baffles which are typically anchored to the interior wall of the cast member, the mandrel assembly shown in FIG. 11 may be slightly modified so as to receive a right-hand portion of a plastic fixture 42, shown in FIGS. 15*a*–15*c*, and provided with a ring-shaped portion 42*a* having a plurality of outwardly directed integral projections 42*b*, each provided with a small opening.

Circular portion 42*a* has a tapered, conical edge 42*c*, a portion of which snaps into a slight recess within the left-hand end of the mandrel assembly. The fixture is snapped onto the left-hand end of the mandrel assembly after the gasket has been mounted upon the mandrel assembly. The remaining steps in the casting method are substantially identical to those described hereinabove in connection with FIGS. 11*a*–11*d*.

When the jacket 20 is opened to remove the mandrel assembly, the cast material surrounds the beveled edge 42*c* preventing the fixture from being pulled outwardly toward the left. The projections 42*b* engage the left-hand surface of the cast member C'", preventing the plastic fixture from being pulled to the right as the mandrel assembly is removed from the cast member. The plastic baffle 44 has a plurality of projections (equal in number to the openings in projections 42*b* of fixture 42) which are each snap-fitted into one of the openings provided in projections 42*b*. These snap-on fasteners retain the plastic baffle in position within the cast member.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. A mold assembly comprising:

an inner core and an outer jacket, at least a portion of which is relatively movable between an opened and a closed position, said core and jacket defining a hollow region for receiving cast material to produce a cast member;

a mandrel assembly mounted upon an interior surface of said movable portion, for forming an opening in a cast member when said movable portion is closed;

said mandrel assembly including means for receiving and supporting an annular-shaped gasket having an outer embedment end and an inner pipe engaging end, said pipe engaging end being supported by said mandrel assembly;

said mandrel assembly being withdrawn through said gasket when the cast material has cured and said movable portion is moved to the open position thereby forming an opening in said cast member in which the embedment end of said gasket is embedded therein and the pipe engaging end extends radially inwardly for engagement with a pipe extended therein to form a water-tight joint therebetween;

wherein the axial length of the mandrel assembly is less than the distance between opposed interior surfaces of said core and said jacket whereby a free end of said mandrel assembly is displaced from an opposed surface of said core member to form a gap region, whereby the cast material enters the gap region thereby forming a block out area which may be selectively broken away to permit insertion of a pipe therethrough.

2. The mold assembly of claim 1 wherein a gap distance of the gap region between adjacent surfaces of the free end of said mandrel assembly and the opposed surface of said core is of the order of one-half inch in thickness.

3. A mold assembly comprising:

an inner core and an outer jacket, at least a portion of which is relatively movable between an open and a closed position, said core and jacket defining a hollow region for receiving cast material to produce a cast member;

a mandrel assembly mounted upon an interior surface of said movable portion, for forming, an opening in a cast member when said movable portion is closed;

said mandrel assembly including means for receiving and supporting an annular-shaped gasket having an outer embedment end and an inner pipe engaging end, said pipe engaging end being supported by said mandrel assembly said mandrel assembly being withdrawn through said gasket when the cast material has cured and said movable portion is moved to the open position thereby forming an opening in said cast member in which the embedment end of said gasket is embedded therein and the pipe engaging end extends radially inwardly for engagement with a pipe extended therein to form a water-tight joint therebetween;

a plastic, circular-shaped knockout cap releasably mounted upon to a free end of said mandrel assembly and having a beveled edge which is surrounded by the cast material placed in the mold to retain the knockout cap in position after the cast member has been cured and the mandrel assembly has been withdrawn from the cast member; and the knockout cap being capable of being knocked out by a suitable blow when it is desired to provide a gasketed opening in said cast member for receiving a pipe therethrough.

4. A mold assembly comprising:

an inner core and an outer jacket, at least a portion of which is relatively movable between an opened and a closed position, said core and jacket defining a hollow region for receiving cast material to produce a cast member;

a mandrel assembly mounted upon an interior surface of said movable portion, for forming an opening in a cast member when said movable portion is closed;

said mandrel assembly including means for receiving and supporting an annular-shaped gasket having an outer embedment end and an inner pipe engaging end, said pipe engaging end being supported by said mandrel assembly;

said mandrel assembly being withdrawn through said gasket when the cast material has cured and said movable portion is moved to the open position thereby forming an opening in said cast member in which the embedment end of said gasket is embedded therein and the pipe engaging end extends radially inwardly for engagement with a nine extended therein to form a water-tight joint therebetween;

wherein a plastic supporting fixture is releasably mounted to a free end of said mandrel assembly and is comprised of an annular-shaped body having a plurality of outwardly directed flanges, each flange being provided with an opening, said fixture lying against an interior wall of a member provided for casting said mold assembly, each flange having an opening for receiving snap-on fasteners provided on a plastic baffle mounted within an interior of the cast member.

5. A mold assembly comprising:

an inner core and an outer jacket, at least a portion of which is relatively movable between an opened and a closed position, said core and jacket defining a hollow region for receiving cast material to produce a cast member;

a mandrel assembly mounted upon an interior surface of said movable portion for forming an opening in a cast member when said movable portion is closed;

said mandrel assembly including means for receiving and supporting an annular-shaped gasket having an outer embedment end and an inner pipe engaging end, said pine engaging end being supported by said mandrel assembly;

said mandrel assembly being withdrawn through said gasket when the cast material has cured and said movable portion is moved to the open position thereby forming an opening in said cast member in which the embedment end of said gasket is embedded therein and the pipe engaging end extends radially inwardly for engagement with a pipe extended therein to form a water-tight joint therebetween;

wherein said mandrel assembly is a one-piece member having an annular recess for receiving and supporting the pipe engaging end of said gasket which is stretched over said mandrel assembly in order to place the pipe engaging portion of the gasket in said recess.

6. A mold assembly comprising:

an inner core and an outer jacket, at least a portion of which is relatively movable between an opened and a closed position, said core and jacket defining a hollow region for receiving cast material to produce a cast member;

a mandrel assembly mounted upon an interior surface of said movable portion, for forming an opening in a cast member when said movable portion is closed;

said mandrel assembly including means for receiving and supporting an annular-shaped gasket having an outer embedment end and an inner pipe engaging end, said pipe engaging end being supported by said mandrel assembly;

said mandrel assembly being withdrawn through said gasket when the cast material has cured and said movable portion is moved to the open position thereby forming an opening in said cast member in which the embedment end of said gasket is embedded therein and the pipe engaging end extends radially inwardly for engagement with a pipe extended therein to form a water-tight joint therebetween;

said one-piece mandrel assembly is a one-piece member having said annular recess for receiving and supporting the pipe engaging end of said gasket which is stretched over said mandrel assembly in order to place the pipe engaging portion of the gasket in said recess;

an outer end section having a truncated, conical shape and an inner end section having a truncated, conical shape, wherein the taper of said inner end section is less than the taper of said outer end section;

a gap being provided between the outer end of the inner section and the inner end of the outer section forming an annular recess for receiving and supporting the pipe engaging end of said gasket; and an inner end of the outer section having a first circular edge which is equidistant from a central axis of said mandrel assembly and has a diameter greater than a second circular edge of an outer end of the inner section which also is equidistant from said central axis, for facilitating withdrawal of the mandrel assembly through the gasket when the cast member has cured and said movable portion is opened.

7. The mold assembly of claim 6 wherein the outer end of the outer section of said mandrel assembly has a diameter greater than the diameter of the inner end thereof, the surface of the outer portion tapering linearly therebetween; and the inner end of the inner section having a diameter slightly less than the diameter of the outer end thereof, the surface of said inner portion tapering linearly therebetween.

8. A mold assembly comprising an outer jacket and an inner core member and a mandrel assembly wherein said mandrel assembly comprises first and second members releasably joined to one another defining an annular recess therebetween for receiving a pipe engaging portion of a gasket;

said first member and said gasket joined to a movable portion of the outer jacket of the mold assembly, said movable portion being movable between an open and a closed position;

said second member being permanently retained in said cast member without interfering with a pipe insulated into the gasket and said first member being removed from said cast member when said moveable portion is opened; and said gasket having an embedment portion for embedment in a cast member formed in the mold assembly.

9. The mold assembly of claim 8 further comprising a knock-out end cap fitted upon said first member for closing the opening, said end cap being retained in place by said cast member and being capable of being knocked out to permit use of the gasketed opening.

10. A mold assembly comprising:

an inner core and an outer jacket, at least a portion of one of said core and said jacket being moveable between an open and a closed position, said core and jacket defining a hollow region for receiving cast material to produce a cast member;

a three-piece mandrel assembly comprised of a first member mounted upon an interior surface of said moveable portion, and second and third annular members snap-fitting joined to an annular gasket;

said second and third annular mandrel members joined to said gasket being releasably mounted upon said first mandrel member to position said gasket displaced from said inner core and said outer jacket when said movable portion is closed;

said first mandrel member being withdrawn from said first and second mandrel members and said gasket when said movable portion is opened; and said second and third mandrel members and said gasket being embedded in a cast member formed in said mold assembly.

11. A mold assembly comprising:

an inner core and an outer jacket, at least a portion of which is relatively movable between an opened and a closed position, said core and jacket defining a hollow region for receiving cast material to produce a cast member;

an annular-shaped resilient gasket having an outer embedment portion and an inner pipe engaging portion joined to said embedment portion by an intermediate portion, said inner, outer and intermediate portions of said gasket being radially aligned when the gasket is in an unstressed state, said intermediate portion being shaped to experience bending prior to bending of said inner and outer portions when a lateral force is exerted on said inner portion;

a mandrel assembly for forming an opening in the cast member, having a first end mounted upon an interior surface of said movable portion, for forming a tapered opening portion of said opening, a free second end extending toward said core when said jacket is in the closed position for forming an opening portion of said opening of substantially constant diameter and an annular recess intermediate said first and second ends for receiving and supporting an inner end of said pipe engaging portion, said intermediate and outer portions of said gasket extending radially outward from said inner, pipe engaging portion when the gasket is mounted on the mandrel assembly;

said mandrel assembly free second end, which engages but is not secured to the inner core, is free to be withdrawn through said gasket inner portion when the cast material has cured and said movable portion is moved to the open position to produce a cast member with the embedment end of said gasket being embedded therein and the pipe engaging end extending radially inwardly from an intermediate portion of said opening for engagement with a pipe when extended therein to form a water-tight joint therebetween.

12. The mold assembly of claim 11 wherein the second end of said mandrel assembly comprises a cylindrical-shaped section and the first end of the mandrel assembly comprises a truncated, conical-shaped section; and said recess being positioned between a smaller diameter end of said truncated, conical-shaped section and an adjacent end of said cylindrical-shaped section.

13. The mold assembly of claim 11 wherein said mandrel assembly is formed of one of materials taken from a group consisting of metal and a suitable rugged plastic material.

* * * * *

UNITED STATES PATENT AND TRADEMARK OFFICE

CERTIFICATE OF CORRECTION

PATENT NO. : 6,651,949 B1
DATED : November 25, 2003
INVENTOR(S) : Westhoff et al.

It is certified that error appears in the above-identified patent and that said Letters Patent is hereby corrected as shown below:

Column 1,
Line 42, delete “jacket A” and insert therefor -- Jacket. A --.

Column 2,
Line 6, after the word "the", delete "present," and insert therefor -- present --.
Line 10,. after the word "Is", delete "highly," and insert therefor -- highly --.
Line 40, after the word "plastic", delete "outer," and insert therefor -- outer-. --.
Line 54, after the word "member, delete "The," and insert therefor -- The --.
Line 56, after the word "portion", delete "adjacent." and insert therefor-- adjacent --.

Column 3,
Line 25, after the word "gasket", delete "between,the" and insert therefor
-- between the --.
Line 45, after the word "adjacent", delete "brand" and insert therefor -- to and --.
Line 80, after the first instance of the word "the", delete 'block-but" and insert therefor
-- block-out --.

Column 4,
Line 7, after the word "present", delete "invention; and insert therefor -- invention --.
Line 25, after the word "to", delete "provide," and insert therefor -- provide --.
Lines 34-35, after the word "to", delete "snap fittingly" and insert therefor
-- snap-fittingly --.

Column 5,
Line 22, after the word "views", delete "-similar" and insert therefor -- similar --.
Line 39, delete "block-out," and insert therefor -- block-out --.
Line 45, delete "through," and insert therefor -- through --.
Line 59, after the word "details", delete "of," and insert therefor -- of --.
Line 60, after the word "the", delete "aforementioned." and insert therefor
-- aforementioned --.

Column 6,
Line 3, after the word "region", delete "between," and insert therefor -- between --.
Line 28, delete "14a," and insert therefor -- 14a --.

UNITED STATES PATENT AND TRADEMARK OFFICE

CERTIFICATE OF CORRECTION

PATENT NO. : 6,651,949 B1 
DATED : November 25, 2003
INVENTOR(S) : Westhoff et al.

It is certified that error appears in the above-identified patent and that said Letters Patent is hereby corrected as shown below:

Column 7,
Line 4, after the word "opening", delete "O1"
Line 17, after the word "causing", delete "14."
Line 64, after the word "the", delete embodiment:" and insert therefor
-- embodiment --.

Column 9,
Line 19, after the word "member", delete "C" and insert therefor -- C' --.
Line 64, after the word "enters", delete "into," and insert therefor -- into --.

Column 10,
Line 24, after the word "edge", delete "42c." and insert therefor -- 42c --.
Line 36, after the word "member", delete " C"' " and insert therefor -- C"" --.

Column 11,
Line 26, after the word “movable”, delete “portion for” and insert therefore -- portion, for --.
Line 27, after the word “for”, delete “forming,” and insert therefore -- forming --.

Signed and Sealed this

Twenty-fourth Day of August, 2004

JON W. DUDAS
*Director of the United States Patent and Trademark Office*

UNITED STATES PATENT AND TRADEMARK OFFICE

CERTIFICATE OF CORRECTION

PATENT NO. : 6,651,949 B1
DATED : November 25, 2003
INVENTOR(S) : Westhoff et al.

It is certified that error appears in the above-identified patent and that said Letters Patent is hereby corrected as shown below:

Column 5,
Line 22, after “views”, delete “-similar” and insert -- similar --.
Line 39, delete “block-out,” and insert -- block-out --.
Line 45, delete “through,” and insert -- through --.
Line 59, after “details”, delete “of,” and insert -- of --.
Line 60, after “the”, delete “aforementioned.” and insert -- aforementioned --.

Column 6,
Line 3, after “region”, delete “between,” and insert -- between --.
Line 28, delete “14a,” and insert -- 14a --.

Column 7,
Line 4, after “opening”, delete “O1”.
Line 17, after “causing”, delete “14”.
Line 64, after “the”, delete “embodiment:” and insert -- embodiment --.

Column 9,
Line 19, after “member”, delete “C” and insert -- C’ --.
Line 64, after “enters”, delete “into,” and insert -- into --.

Column 10,
Line 24, after “edge”, delete “42c,” and insert -- 42c --.
Line 36, after “member”, delete “C”’ ” and insert -- C”” --.

Column 11,
Line 27, after “for”, delete “forming,” and insert -- forming --.

UNITED STATES PATENT AND TRADEMARK OFFICE

CERTIFICATE OF CORRECTION

PATENT NO. : 6,651,949 B1
DATED : November 25, 2003
INVENTOR(S) : Westhoff et al.

It is certified that error appears in the above-identified patent and that said Letters Patent is hereby corrected as shown below:

Column 12,
Line 26, after "movable", delete "portion for" and insert -- portion, for --.

Signed and Sealed this

Twenty-fourth Day of January, 2006

JON W. DUDAS
*Director of the United States Patent and Trademark Office*